United States Patent [19]

Bunnell et al.

[11] 3,993,579

[45] Nov. 23, 1976

[54] METHOD OF ENCAPSULATING SOLID RADIOACTIVE WASTE MATERIAL FOR STORAGE

[75] Inventors: Lee Roy Bunnell, Kennewick; J. Lambert Bates, Richland, both of Wash.

[73] Assignee: The United States of America as represented by the United States Energy Research and Development Administration, Washington, D.C.

[22] Filed: Oct. 22, 1975

[21] Appl. No.: 624,805

[52] U.S. Cl. ..... 252/301.1 W; 264/.5

[51] Int. Cl.[2] ..... G21F 9/34

[58] Field of Search ..... 252/301.1 R, 301.1 W; 264/.5

[56] References Cited

UNITED STATES PATENTS

| | | | |
|---|---|---|---|
| 3,249,551 | 5/1966 | Bixby | 252/301.1 W |
| 3,340,567 | 9/1967 | Flack et al. | 252/301.1 S |
| 3,644,604 | 2/1972 | Hooker | 252/301.1 R |
| 3,854,979 | 12/1974 | Rossi | 427/376 |

OTHER PUBLICATIONS

Kaufmann, A. Ed. *Nuclear Reactor Fuel Elements* Interscience Publishers (a division of John Wiley & Sons), New York, 1962, p. 478.

*Primary Examiner*—Benjamin R. Padgett
*Assistant Examiner*—Deborah L. Kyle
*Attorney, Agent, or Firm*—Dean E. Carlson; Arthur A. Churm; James W. Weinberger

[57] ABSTRACT

High-level radioactive wastes are encapsulated in vitreous carbon for long-term storage by mixing the wastes as finely divided solids with a suitable resin, formed into an appropriate shape and cured. The cured resin is carbonized by heating under a vacuum to form vitreous carbon. The vitreous carbon shapes may be further protected for storage by encasement in a canister containing a low melting temperature matrix material such as aluminum to increase impact resistance and improve heat dissipation.

8 Claims, No Drawings

METHOD OF ENCAPSULATING SOLID RADIOACTIVE WASTE MATERIAL FOR STORAGE

CONTRACTUAL ORIGIN OF THE INVENTION

The invention described herein was made in the course of, or under, a contract with the U.S. ENERGY RESEARCH AND DEVELOPMENT ADMINISTRATION.

BACKGROUND OF THE INVENTION

This invention relates to a method for the preparation of radioactive wastes for storage. More specifically, this invention relates to an improvement in the method for the preparation of high-level radioactive waste solids for storage by encapsulation of the wastes in vitreous carbon.

The chemical reprocessing of spent nuclear reactor fuel elements to recover the unburned nuclear reactor fuel material generates large volumes of aqueous solutions containing radioactive wastes. Not only are there large volumes of solutions, but the solutions are very corrosive and therefore are difficult to handle and store. Since long-term storage of these wastes is necessary to permit decay of the highly radioactive fission products contained therein, the aqueous wastes are converted to a solid form which occupies less volume than the corresponding liquid wastes, is less corrosive and poses less difficult problems in handling and long-term storage. These aqueous radioactive waste solutions can be converted to solid form by spray solidification, fluidized-bed calcination, pot calcination, or by heating to dryness and sintering the resulting solid.

However, the high-level waste solids prepared by the above methods must still be stored for an extended period of time. Many methods for preparing these wastes for storage, so that they pose no present or future threat to the environment, have been and are presently being investigated. For example, the waste might be stored as granular material in metal canisters either in the open, or in water-filled storage tanks. The wastes might be mixed with concrete, asphalt or formed into any one of a number of different mixes of glasses. However, most of these methods have problems attendant with their use for the long-term storage of high-level radioactive wastes. For example, metal canisters can leak, releasing radioactivity to the atmosphere, wastes tied up in concrete or in many glasses may be leached, i.e., water may dissolve soluble radioactive salts which could then contaminate the environment. Glasses may also devitrify which will increase leach rates above acceptable levels and both concrete and glass have poor thermal conductivity which may prevent effective dissipation of the thermal energy generated by the radioactive material.

SUMMARY OF THE INVENTION

We have found that, by encapsulating the high-level radioactive solid waste material in vitreous carbon, we are able to eliminate some of the above-enumerated problems. By the method of our invention, powdered high-level radioactive waste solids are mixed with a curable resinous material, formed into an appropriate shape for storage and cured. The cured shape is then heated under a vacuum to 600–1000° C. for a sufficient period of time to carbonize the cured resinous shape to vitreous carbon, encapsulating the high-level radioactive waste solids. Additional physical protection and improved thermal conductivity can be provided the vitreous carbon shape by placing a plurality of the shapes into a metal canister in a regular spaced array and filling the canister including the interstices between the shapes with a low-melting molten matrix material such as aluminum.

The method of the invention has several advantages over the prior art methods for preparing highly radioactive waste solids for storage. For example, the resin and radioactive material can be mixed and the shapes formed at room temperature. The resistance of vitreous carbon to leaching is much better than concrete and generally superior to the glasses, particularly when the glasses are subject to devitrification. Thermal conductivity of the carbon and metal matrix is much better than either concrete, asphalt or glass. In the event that recovery of the wastes is desirable in the future, simple combustion in air of the vitreous carbon will permit easy retrieval.

It is therefore one object of the invention to provide an improved method for preparing high-level radioactive wastes for long-term storage.

It is another object to provide a method for preparing high-level radioactive wastes for long-term storage by encapsulation of the wastes in vitreous carbon.

DESCRIPTION OF THE PREFERRED EMBODIMENT

These and other objects of the invention may be met by mixing the solid high-level radioactive waste material as a −325 mesh powder with a curable resinous material to form a resinous mixture containing about 50 weight percent waste material, casting the resinous mixture into a sheet up to ⅛ inch thick for storage, curing the shaped resinous mixture, and heating the sheet of cured resinous material in a vacuum or inert atmosphere to from 600° to 1000° C. for a period of time sufficient to convert the resinous material to vitreous carbon, thereby providing a sheet of high-level radioactive waste material encapsulated in vitreous carbon ready for long-term storage.

The highly radioactive waste material should be a fine powder no more than about 325 mesh in size for best results. Since there is a large decrease in resin volume during the carbonizing process, larger particle sizes may result in the formation of cracks in the vitreous carbon shapes.

Any solid waste material may be used with the method of the invention as long as it is reasonably inert so that it does not react with the catalyst in the resin. Thus it is preferred that the waste material have been calcined to ensure that only inert oxides are present.

The amount of waste material in the resinous mixture is generally limited to a mixture consistency which can be easily worked. If shapes, such as rods, which can be formed by extrusion are to be prepared, the resinous mixture may contain up to about 70 weight percent waste material, while if flat sheets or spheroids are to be formed, up to about 50 weight percent waste material is the practical limit.

The curable resinous material may be any thermosetting resin which is liquid at room temperature and which has a high carbon yield. One such resin which was found to give good results was polyfurfuryl alcohol although other thermosetting resins such as phenol-formaldehyde can be used in the practice of this invention.

It was generally found that the presence of large quantities of powdered material in the precursor resin required that additional catalyst be added in order to achieve curing within a reasonable period of time. Care must also be taken in order to prevent the curing from proceeding too rapidly and thus producing a large amount of heat which may result in some undesirable cracking.

One limitation of the method of this invention is that in order to prevent the formation of cracks in the shapes during carbonization the shapes are limited to about ¼ inch in thickness. Three shapes have been found useful with the method of this invention. Resinous mixtures containing up to 70 weight percent solid material may be extruded into rods up to ¼ inch in cross section for curing, carbonization and subsequent storage. Mixtures containing up to 50 weight percent may be either cast into sheets up to about ⅛ inch in thickness or formed into small spheriods. The spheroids, 200–300 $\mu$m in diameter, can be readily prepared by injecting the resinous mixture dropwise into agitated vegetable oil at 100° C. This method is advantageous in that the spheroids are formed and cured within seconds, and could be carbonized in hours.

Carbonization of the cured resinous material containing the solid radioactive waste is readily accomplished by heating the shapes under a vacuum or in an inert atmosphere to from 600° to 1000° C. at a heating rate of about 6° C. per hour to ensure diffusion of gases and complete carbonization of the shapes. Heating should continue for a period of time sufficient to ensure that total carbonization has taken place throughout the entire shape. For rods and sheets of material, carbonization may require from about 100 to 150 hours, while the spheroids 200 to 300 microns in diameter can be carbonized in 9 to 10 hours.

Since the vitreous carbon is brittle and prone to breakage, additional long-term storage protection can be provided by placing a large number of the shapes in a metal canister in a regular spaced array and filling the canister including the interstices between the shapes, with a molten low-melting-temperature matrix material such as aluminum. This matrix material would provide additional impact protection for the vitreous carbon, reduce further any possibility of leaching the radioactive material and further improve the thermal conductivity in the waste container. An advantage of this method is that recovery of the radioactive material still remains a relatively simple procedure, since only the metal need be melted to recover the vitreous carbon sheets.

The following examples are given as illustrating the process of the invention and are not to be taken as limiting the scope or extent of the invention as defined by the appended claims.

EXAMPLE I

To demonstrate the process, Quaker Oats RP 100A resin (polyfurfuryl alcohol) was mixed with about 33 w/o calcined waste with a 400 mesh size. The batch was catalyzed with 8 w/o Quaker Oats RP 104B catalyst which is about 50% over catalyzation to compensate for excess adsorption of the catalyst by the porous waste. Upon completion of curing, the material was heated to 1000° C. in 150 hours to produce a crack-free matrix containing evenly distributed waste material.

EXAMPLE II

To study stability of the resin before conversion to pure carbon, discs of catalyzed polyfurfuryl alcohol resin were cast. The discs were subjected to alpha and gamma radiation, then carbonized to 1000° C. in 150 hours under vacuum. The results are summarized in Table I below. Metallographic examination of carbonized specimens 3 and 7 showed no cracking or evidence of degradation. The gamma dose accumulated by the discs was on the order of $10^9$ rads.

TABLE I

| Sample No. | Irradiation Treatment | Post-Irradiation Appearance | Irradiation Weight Gain (loss), % | % Weight Loss on Carbonization | Appearance after Carbonization |
|---|---|---|---|---|---|
| 3 | αirradiated ~$4 \times 10^{14}$ particles/cm from $^{238}PuO_2$ | Excellent | 0 | 39.7 | Excellent |
| 4 | None (control) | NA | NA | 39.8 | Excellent |
| 5 | γirradiated $2.68 \times 10^8$rad | Excellent | 2%[a] | 40.1 | Excellent |
| 6 | γirradiated $1.35 \times 10^7$ rad | Excellent | 0.6%[a] | 40.0 | Excellent |
| 7 | γirradiated $5.64 \times 10^9$ rad | Excellent | (3.6%)[a] | 40.4 | Excellent |

[a]Variable weight gain or loss probably because of water sorption/desorption in gamma facility.

TABLE II

| Waste Source | W/o Waste | W/o Catalyst | Comments |
|---|---|---|---|
| Calcined Waste, Batch PW-4b, −37 micron (Experiment Standard) | 50 | 8 | Delayed curing because of catalyst sorption. No cracking, excellent microstructure. |
| PyC - Coated particle Batch 5895–85 (300 micron) | 40 | 4 | Curing normal, severely cracked during carbonization. |
| PyC - Coated particle Batch 5768–141 (650 micron) | 47 | 4 | Cure normal, completely disintegrated during carbonization |

EXAMPLE III

Polyfurfuryl alcohol resin was mixed with several batches of simulated waste, in all cases adding waste until the mixture could just be poured. The purpose was twofold: (1) to determine how well the vitreous carbon would tolerate different chemical compositions and (2) to see if the vitreous carbon would tolerate a normal particle size distribution, since previous experiments were done with −400 mesh material. Results are summarized in Table III.

TABLE III

| Waste Type | W/o Waste in Pourable Mix | Curing Behavior | Appearance after Carbonization, External and Metallographic |
|---|---|---|---|
| PW-4b | 47 | Normal | Flat, no cracks, metallographically very good. |
| PW-6 | 36 | Normal | Slight warping, considerable cracking, but fairly sound microstructure. |
| PW-4c-7 | 59 | Extremely slow; required 150° C. to harden | Severely warped and cracked; $Al_2O_3$ particles sank to bottom, rest of waste graded according to settling rate, with almost none at top (concave surface). |

PW-4b is apparently more suitable for containment in vitreous carbon. PW-6 is much less, apparently because of its high residual $NaNO_3$ content, which is about 30 w/o versus almost none in PW-4b. The PW-4c-7 is unsuitable because the alumina substrate particles lost their coating of waste and sank to the bottom, finally creating large cracks because of differential shrinkage. Obviously, the particle size of PW-4b is small enough (or the particles are sufficiently friable) that matrix cracking does not occur.

EXAMPLE IV

In order to study the resistance of the containment material to leaching water, a number of samples of varying compositions were prepared as described previously and subjected to a standard accelerated leach test. The results of the test are given in Table IV below.

TABLE IV

| Sample | W/o Loss First 24 hour | Cumulative W/o Loss Second 24 hour | Cumulative W/o Loss Third 24 hour |
|---|---|---|---|
| Vitreous Carbon No Calcine | 0.09% | 0.13% | Not leached |
| 82 w/o Vitreous Carbon 18 w/o Calcine | 0.44% | 0.47% | 0.52% |
| 47 w/o Vitreous Carbon 53 w/o Calcine | 0.27% | 0.29% | 0.42% |
| 33 w/o Vitreous Carbon 67 w/o Calcine | 1.72% | 1.86% | Not leached Because >1% Limit |

As can be seen from the preceding discussion and examples, the method of this invention for encapsulating solid high-level radioactive waste material in vitreous carbon provides an effective and efficient method for preparing these wastes for long-term storage.

The embodiments of the invention in which an exclusive property or privilege is claimed are defined as follows:

1. A method of preparing solid high-level radioactive waste material for storage by encapsulating the material in vitreous carbon comprising:

mixing powdered high-level radioactive material less 325 mesh with a curable resinous material selected from the group consisting of polyfurfuryl alcohol and phenolformaldehyde to form a resinous mixture containing up to 70 weight percent waste material;

forming the resinous mixture into appropriate shapes for storage;

curing the shaped resinous mixture; and heating the cured shapes to from 600° to 1000° C. under a vacuum or inert atmosphere at a rate of about 6° C. per hour for a period of time sufficient to carbonize the cured resinous material to vitreous carbon, thereby forming shapes of high-level radioactive material encapsulated in vitreous carbon for storage.

2. The method of claim 1 wherein the curable resinous material is a polyfurfuryl alcohol.

3. The method of claim 2 wherein the mixture is cured by heating the shapes for about 2 hours at about 70° C.

4. The method of claim 3 wherein the shapes into which the resinous material is formed are selected from the group consisting of rods, sheets and spheroids.

5. The method of claim 4 wherein the shape is a rod up to ¼ inch in diameter, the rod is formed by extrusion and the resinous mixture contains up to about 70 weight percent waste material.

6. The method of claim 4 wherein the shape is a sheet up to ⅛ inch in thickness, the sheet is formed by casting and the resinous mixture contains up to about 50 weight percent waste material.

7. The method of claim 4 wherein the shape is spheroidal, the spheroids are formed and cured by injecting the resinous mixture dropwise into agitated vegetable oil at 100° C. and the resinous mixture contains up to about 50 weight percent waste material.

8. The method of claim 4 including the additional steps of: placing a plurality of vitreous carbon shapes into a metal canister in a regular spaced array, and filling the canister including the interstices between the carbon shapes with molten aluminum and permitting the aluminum to harden, thereby providing additional protection to the encapsulated high-level waste for long-term storage.

* * * * *